US005899343A

United States Patent [19]

Franklin et al.

[11] Patent Number: 5,899,343

[45] Date of Patent: May 4, 1999

[54] JEWELRY DISPLAY DEVICE

[75] Inventors: Robert P. Franklin, Lake Hopatcong; Eric Henry, Rutherford, both of N.J.; Laura Handler; Francesco Gianisini, both of New York, N.Y.; Amanda Honig Magalhaes, Brooklyn, N.Y.

[73] Assignee: Monet Sales Corp., New York, N.Y.

[21] Appl. No.: 08/757,385

[22] Filed: Nov. 27, 1996

[51] Int. Cl.[6] ..... A47F 5/00

[52] U.S. Cl. ..... 211/85.2

[58] Field of Search ..... 211/85.2, 169, 211/165, 96; 206/472, 566; D3/903

[56] References Cited

U.S. PATENT DOCUMENTS

| | | | |
|---|---|---|---|
| 2,928,555 | 3/1960 | Childs et al. . | |
| 3,391,796 | 7/1968 | Cross | 211/169 |
| 3,514,883 | 6/1970 | Albright . | |
| 3,777,896 | 12/1973 | Ehrlich | 211/169 |
| 4,848,585 | 7/1989 | Snyder . | |
| 5,588,537 | 12/1996 | Hagopian | 211/169 |

*Primary Examiner*—Alvin Chin-Shue
*Assistant Examiner*—Sarah L. Purol
*Attorney, Agent, or Firm*—Cowan, Liebowitz & Latman; Morey B. Wildes

[57] ABSTRACT

A stand-up, book-like jewelry display device has a rectangular frame mounted upright on a horizontal bracket. Product panels that hold jewelry and graphics panels that depict the jewelry in use are rotatably mounted within the frame so that each panel swings about one of its edges, thereby giving the display the appearance of a book with pages to turn. Preferably, the product panels are alternated within the frame. In addition, the graphics panels are preferably narrower than the product panels such that, other than the graphics panel within the "leaf" being viewed, each graphics panel is obscured by the product panel above it so that it does not block from view any jewelry displayed on the product panel below it. In addition, the upright frame may be rotatably mounted to the horizontal bracket such that the frame can be rotated to allow the salesperson to change the displays without having to turn the bracket. The frame may be locked in place by a peg that extends downward through the bottom portion of one side of the frame into a recess in the bracket.

33 Claims, 3 Drawing Sheets

JEWELRY DISPLAY DEVICE

BACKGROUND OF THE INVENTION

This invention relates to jewelry display devices and, more particularly, to jewelry display devices that have swinging display panels.

Retail jewelry vendors have long searched for better ways to display jewelry to their customers. One common device for displaying jewelry for sale is a book-like display, either of the type that lays flat or of the type that stands erect. For example, U.S. Pat. No. 4,848,585 (Snyder) shows a jewelry storage case that has several trays for holding jewelry items, wherein each tray has a plurality of apertures for securing jewelry thereto or a plurality of hooks for hanging jewelry therefrom. The trays are hingedly attached to each other and allow the case to be opened and stood in a vertical orientation or to be closed for storage. This device is also shown in U.S. Design Pat. No. Des. 317,380 (Snyder). In addition, U.S. Design Pat. Nos. Des. 266,115 (Glenn, Sr. et al.) and 348,155 (McCreary et al.) both show book-like jewelry cases in which "pages" for holding jewelry are hingedly attached to one another and which may be closed for storage. U.S. Pat. No. 4,720,012 (Dufour) shows a book-like jewelry case having pages of mesh material onto which jewelry may be hung. Separator pages, each having cushioning on both sides, are bound between the mesh pages, and the front and rear covers also contain cushioning on the inside of each. This device also has a closure means to allow this jewelry display "notebook" to be closed for storage.

Each of the aforementioned jewelry display cases is structured to allow the user to open the display case and display the jewelry by turning the "pages" of the book onto which the jewelry is secured. The case may, in some cases, be stood up vertically to display the jewelry by resting on the bottom edges of the cover or pages of the book when open. Each of these cases may also be closed to allow the jewelry to be stored inside and to allow the jewelry case to be portable. These jewelry cases, however, are structured for portable displays and not for a larger retail display that can be attached to a counter top. In addition, these jewelry cases in no way allow a customer to see how the jewelry appears in use. It is desirable to provide a stand-up display that allows salespeople and consumers to "page" through displayed jewelry and that graphically depicts the jewelry in use.

Some display stands have allowed retail exhibition of jewelry in a non-portable frame. For example, U.S. Pat. No. 5,087,105 (White) shows an earring rack having two shutters hingedly attached to the outside edges of a grid frame. In this patent, the grid frame is mounted in a stationary position to a flat base to prevent the rack from tipping over when jewelry is removed therefrom or when the shutters are swung open. However, White departs from the book-like design, as the shutters give the device the appearance of a window and not the appearance of a book.

U.S. Pat. Nos. 2,928,555 (Childs et al.), 3,391,796 (Cross) and 3,514,883 (Albright) all show display devices having a series of swinging panels pivotally mounted within a frame. Childs et al. discloses a mounting arrangement for panels of electrical components in which each panel swings from one of two pivot points at opposite sides of the frame, wherein offset crank arms provide clearance between each leaf. In both Albright and Cross, each leaf pivots about its own pivot axis set within two parallel stationary tracks. This type of device is commonly used to display items such as posters, photographs, compact discs, etc. For such large display devices, however, it is desirable to provide a mechanism for allowing a salesperson to quickly and easily change displays without having to cross to the opposite side of the sales counter. This is generally not possible with devices such as in Albright and Cross, which are mounted to a wall or some other vertical support surface.

Accordingly, it is one object of this invention to provide a jewelry display device that allows salespeople and customers to "page" through displayed jewelry.

It is another object of this invention to provide a jewelry display device that graphically depicts the jewelry on display.

It is a further object of this invention to provide a countertop jewelry display device that allows a salesperson to quickly and easily change displays without having to cross to the opposite side of the display.

SUMMARY OF THE INVENTION

In accordance with the objects of the invention, a stand-up, book-like jewelry display device is provided. This device consists of a rectangular frame mounted upright on a horizontal bracket. Product panels and graphics panels are rotatably mounted within the frame so that each panel swings about one of its edges, thereby giving the display the appearance of a book with pages to turn. Preferably, product panels, which contain jewelry display racks for mounting "cards" that hold jewelry, and graphics panels, which depict the jewelry in use, are alternated so that each "leaf" of the display has a product panel on one side and a graphics panel on the other side. In addition, the graphics panels are preferably narrower than the product panels such that, other than the graphics panel within the "leaf" being viewed, each graphics panel is obscured by the product panel above it so that it does not block from view any jewelry displayed on the product panel below it.

In addition, the upright frame may be rotatably mounted on the horizontal bracket such that the frame can be swiveled or rotated to allow the salesperson to change the displays without having to turn the bracket. The frame may be locked in place either during times of display or while the display is being changed by means of a peg that extends downward through the bottom portion of one side of the frame into a recess in the bracket.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

Figure 1:
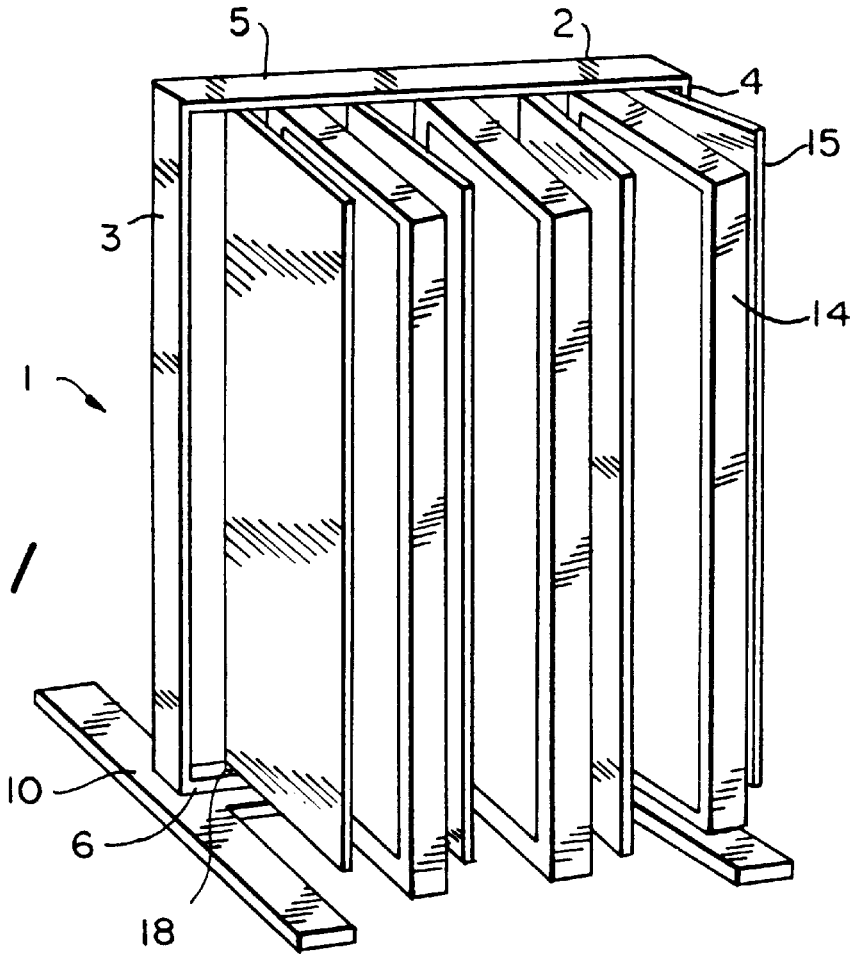
FIG. 1 shows a top, front, left side perspective view of the jewelry display device of the present invention.
Figure 2:
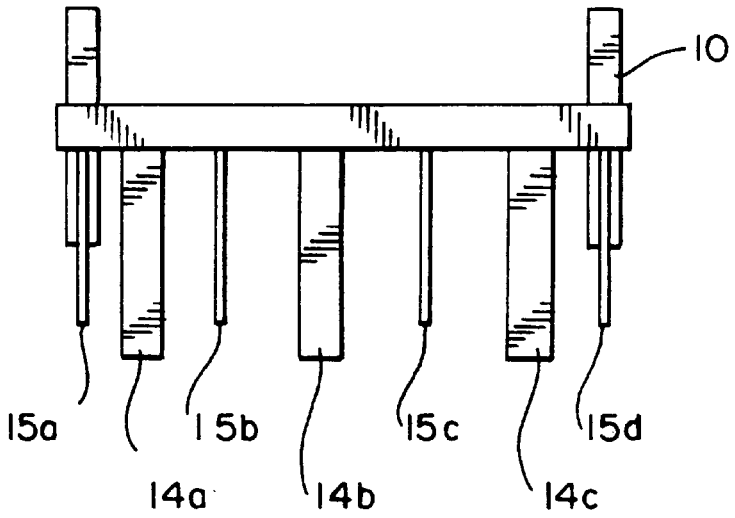
FIG. 2 shows a top plan view thereof.
Figure 3:
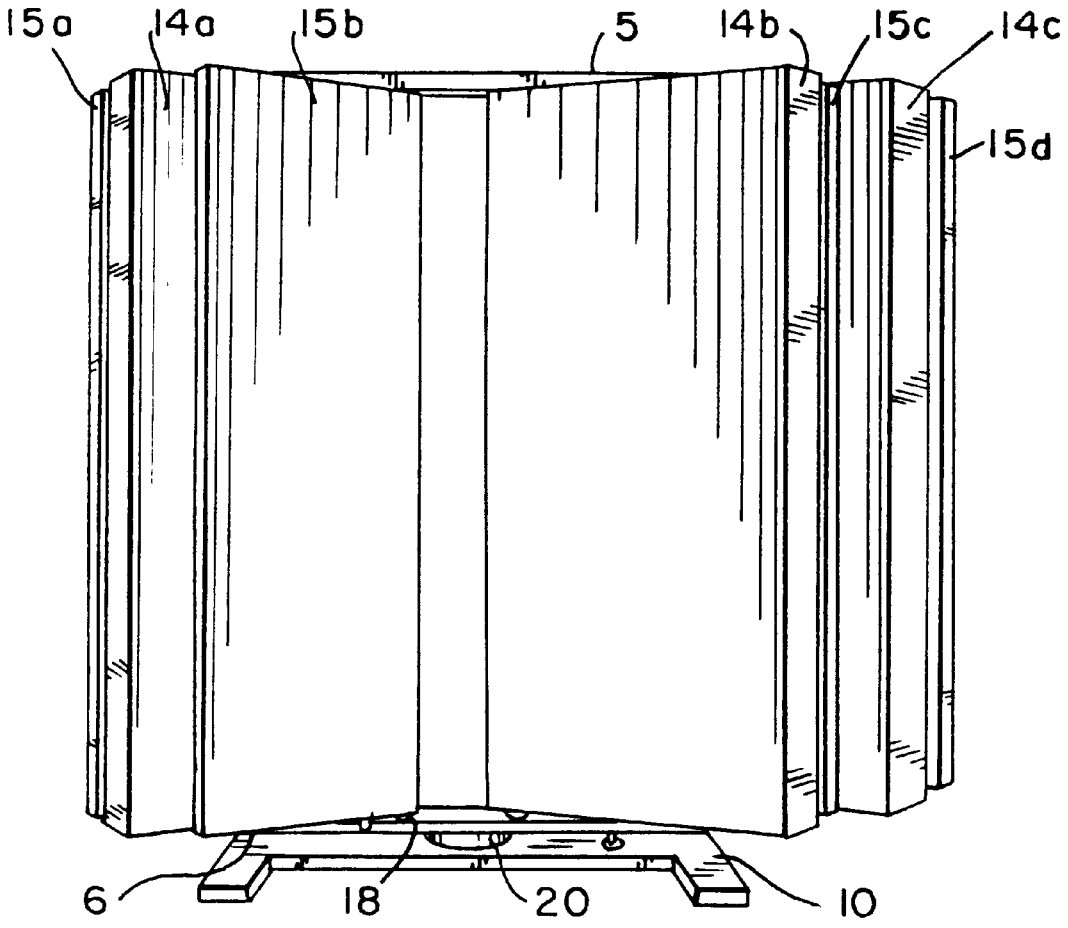
FIG. 3 shows a front elevational view thereof.

Referring now to the figures, the jewelry display device 1 of the present invention has a rectangular frame 2 formed of two substantially parallel side beams 3,4 fixed at right angles between a top mounting strut 5 and a bottom mounting strut 6, which are substantially parallel to each other, as shown in FIGS. 1 and 3. Frame 2 is mounted to a base or bracket 10 that is generally planar in construction so as to be able to rest securely and stably on a flat surface, such as a display counter or a floor. In the embodiment shown in FIGS. 1–4, bracket 10 has the shape of the letter "I" or "H", at the center of which frame 2 is mounted, but bracket 10 may have other shapes while still functioning as described herein. In a preferred embodiment of this invention, as will be discussed later, frame 2 is rotatably mounted to bracket 10. Frame 2 may be formed of any material strong enough to support this device, such as extrusions of plastic, lightweight metal or wood stripping. Bracket 10 should preferably be formed of a heavier material than frame 2 to prevent the display device from toppling over from imbalance during use.

Figure 5:
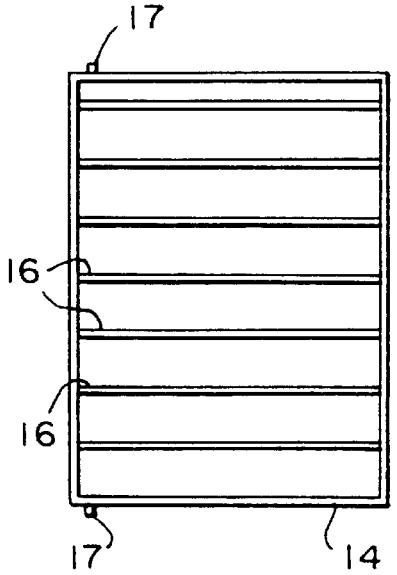
FIG. 5 shows an elevational view of a product panel.

Within frame 2 are mounted several panels 14,15, both for display of jewelry products and other merchandise and for display of graphics. As shown in FIG. 5, the panel 14 for display of jewelry products is substantially rectangular but could have other shapes as desired. Product panel 14 may have any means for attaching jewelry in a way that they may be most attractively displayed to customers. Because jewelry is often distributed or displayed attached to small product cards, one means of attaching the displayed jewelry to product panel 14, as shown in FIG. 5, is with narrow shelves 16 having slots (not shown) behind them for insertion of a clip or folded-over portion of the product card. Other attachment means may be provided as appropriate.

Figure 6:
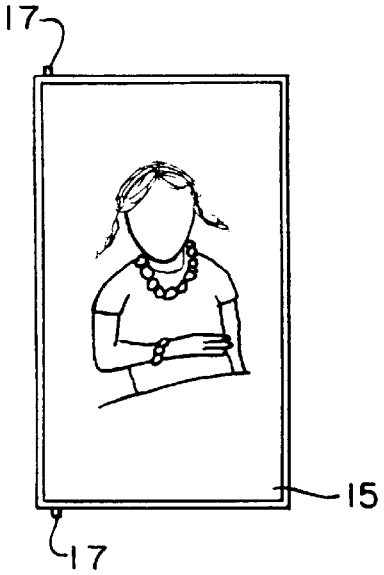
FIG. 6 shows an elevational view of a graphics panel.

Graphics panel 15, shown in FIG. 6, is substantially the same shape and height as product panel 14 but, for reasons that will be discussed below, is somewhat narrower than product panel 14. The height and widths of panels 14,15 are limited only by the size of frame 2 and by the size of the display area. In one embodiment, all panels 14,15 are approximately eighteen inches tall, product panels 14 are approximately ten inches wide, and graphics panels 15 are approximately nine inches wide. It is also within the scope of the invention for the panels to be anywhere from approximately twelve to approximately thirty-six inches in height and from approximately five to approximately twenty inches in width.

In general, graphics panel 15 is used generally to depict the jewelry displayed on product panel 14 in use, either by photograph, drawing or some other indicia. Because the display of jewelry on product panels 14 may be changed, the graphics on graphics panels 15 should also be changeable. Therefore, in a preferred embodiment, graphics shown on graphics panel 15 can be detached and replaced. This can be done by using panels of cardboard or other materials held in place by borders on graphics panel 15, by magnetized means, by hook-and-loop mechanisms, such as Velcro®, or other detachable mechanisms.

Product and graphics panels 14,15 are rotatably mounted within frame 2 in a spaced relation whereby the appearance of a "book-like" display is given, as will be discussed. Each panel 14,15 possesses vertically-aligned coaxial dowels or hinge pins 17 affixed, facing outwardly, to one side of the top and bottom edges of panels 14,15, as shown in FIGS. 5 and 6. Pins 17 are inserted rotatably into vertically-aligned apertures 18 that are spaced longitudinally within the insides of top and bottom mounting struts 5,6 of frame 2, such that panels 14,15 are allowed to swing freely within frame 2 almost a full 180° about the axis created by pins 17. Panels 14,15 thereby appear as "pages" within a book. For reasons of strength and rigidity, pins 17 should extend into apertures 18 in sufficient distances to give the necessary strength so that pins 17 will not break loose from panels 14,15, either at the top or bottom edges. Pins 17 may also be spring-loaded to allow for easy insertion and removal of panels 14,15.

Alternatively, instead of having apertures 18 spaced along their insides, top and bottom mounting struts 5,6 may each have a longitudinal channel (not shown) formed in its inside surface. Pins 17 may be inserted into these channels so that pins 17 freely rotate and slide within the channels. In this embodiment, panels 14,15 may swing freely within frame 2 but may also slide freely within frame 2 from one side to the other.

Any number of panels 14,15 may be mounted in frame 2, and the number of panels 14,15 is limited only by the size (or width) of frame 2, which in turn is limited by the size of the display area. Preferably, there should not be fewer than three or more than twenty-one panels total. Panels 14,15 are alternatingly arranged within frame 2 so that each product panel 14 is flanked by a graphics panel 15 on either side and, except for the two end-most graphics panels 15, visa versa. This alternating graphics-product-graphics panel arrangement is shown best in FIG. 2. In this embodiment, three product panels 15 are arranged among four display panels 14.

As shown in FIGS. 2, 5 and 6, and as discussed above, graphics panels 15 are preferably somewhat more narrow than product panels 14. This is done so that, except for the "leaf" open to the customer, product panels bearing jewelry are not obscured by graphics panels. As shown in FIG. 3, the "leaf" in view to the customer consists of graphics panel **15*b* and product panel 14*b* open to view. Thus, to the left of the open leaf, a portion of product panel 14*a* is seen. However, because graphics panel 15*a* is more narrow than product panel 14*a*, graphics panel 15*a* is not seen at all. To the right of the open leaf, a similar situation exists. Because graphics panel 15*c* is narrower than product panels 14*b* and 14*c*, it is completely hidden behind product panel 14*b* and does not obscure any part of product panel 14*c*. Similarly, because graphics panel 15*d* is narrower than product panel 14*c*, it is completely hidden behind product panel 14*c*** and is not seen at all.

As discussed above, the jewelry display device 1 of this invention is designed to be free-standing on a horizontal surface, such as a countertop, and, therefore, must be weighted in such a way that it does not topple over during use from imbalance. Because bracket 10 is formed from a heavier material, movement of bracket 10 is difficult. Thus, in another feature of the present invention, frame 2 is rotatably mounted on bracket 10 so that jewelry in the display device 1 can be changed quickly and easily by a sales person with a minimum of effort. To this end, frame 2 is rotatably mounted to bracket 10 by any suitable mounting means 20.

Figure 4:
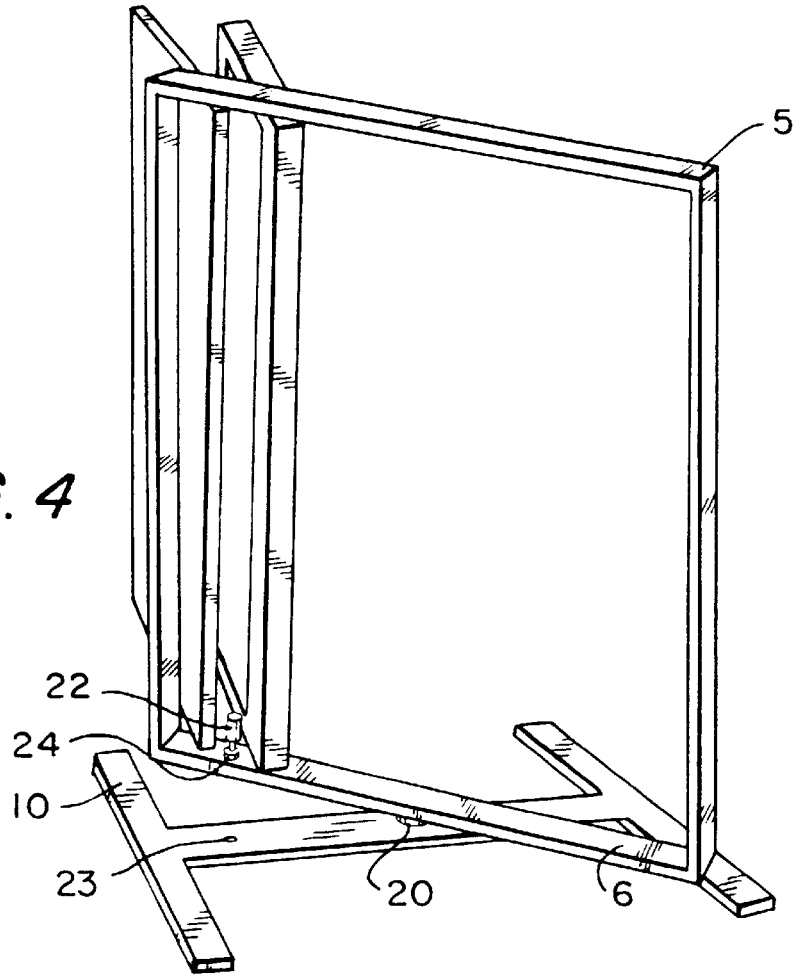
FIG. 4 shows a back perspective view thereof in an unlocked and partially swiveled position.

However, frame 2 must be secured to bracket 10 and held immobile during use so that frame 2 does not move or rotate when touched or handled by customers or sales people. Thus, as shown in FIG. 4, a locking mechanism, comprising bolt or peg 22 and recess 23, secures frame 2 from rotating relative to bracket 10 during use. Peg 22 is affixed to bottom strut 6 of frame 2 and has "up" and "down" positions such that, when depressed downward, its bottom portion projects through an aperture 24 in bottom strut 6 and, when pulled upwards, its bottom portion does not project. Recess 23 is set within bracket 10 in a position to cooperate with peg 22 in strut 6. Thus, when frame 2 is in its normal display position facing forward, peg 22 is depressed downward into recess 23 so as to set frame 2 relative to bracket 10. When it is desired to change the display either of jewelry on product panels 14 or of graphics on graphics panels 15, peg 22 is pulled to its "up" position, thereby raising the bottom portion of peg 22 out of recess 23 and thereby allowing frame 2 to rotate freely about rotating means 20 on bracket 10. In this way, frame 2 may be turned around towards the sales-person.

Bracket 10 could also have a second recess (not shown) on the side opposite to recess 23 in order to secure frame 2 relative to bracket 10 after frame 2 has been rotated toward the salesperson. Thus, after frame 2 has been rotated 180° from its original display position, peg 22 is depressed downward into the second recess to set frame 2 in position while the displays on panels 14,15 are being changed.

Thus, a jewelry display device having swinging display panels is provided. One skilled in the art will appreciate that the present invention can be practiced by other than the described embodiments, which are provided for purposes of illustration and not limitation, and that the present invention is limited only by the claims that follow.

What is claimed is:

1. A jewelry display device comprising:

a frame;

a plurality of planar product display panels rotatably mounted within said frame; and a plurality of planar graphics display panels rotatably mounted within said frame;

wherein said product panels and said graphics panels have substantially the same height but said product panels are wider than said graphics panels, and wherein said product panels and said graphics panels are mounted alternatingly, such that when least two of said product panels and one of said graphics panels between them are turned to one side, said graphics panels is not normally visible behind one of said wider product panels.

2. The jewelry display device according to claim 1, wherein said frame comprises two substantially parallel horizontal mounting bars, one upper and one lower, to which said product panels and said graphics panels are mounted.

3. The jewelry display device according to claim 2, wherein each of said product and graphics panels comprises a mounting pin both at the top edge and at the bottom edge thereof for rotatably mounting of said panel to said frame.

4. The jewelry display device according to claim 3, wherein said frame further comprises a plurality of longitudinally-spaced mounting apertures within each of said horizontal mounting bars within which apertures said mounting pins are rotatably placed for rotatably mounting said product and graphics panels.

5. The jewelry display device according to claim 4, wherein said mounting pins form a rotation axis about which said panel rotates relative to said frame.

6. The jewelry display device according to claim 5, wherein said rotation axis is situated adjacent one side edge of said panel such that said panel rotates in swinging relation to said frame.

7. The jewelry display device according to claim 6, wherein said frame further comprises two substantially parallel vertical bars joining said two horizontal mounting bars at the ends thereof such that said panels are prevented from swinging in angles of greater than 180°.

8. The jewelry display device according to claim 3, wherein said frame further comprises a channel within each of said mounting bars within which channel said mounting pins are rotatably and slidably placed for mounting said product and graphics panels.

9. The jewelry display device according to claim 8, wherein said frame further comprises two substantially parallel vertical bars joining said two horizontal mounting bars.

10. The jewelry display device according to claim 1, wherein each of said product display panels comprises a rectangular panel onto which may be removably attached a plurality of jewelry products for display.

11. The jewelry display device according to claim 10, wherein each of said graphics display panels comprises a rectangular panel on which may be depicted graphics showing the use of said jewelry products on display on said product panels.

12. The jewelry display device according to claim 11, wherein said product panels and said graphics panels are mounted side by side and alternatingly, such that each graphics panel depicts the use of jewelry products on display on an adjacent product panel.

13. The jewelry display device according to claim 12, wherein said product panels and said graphics panels are mounted side by side and alternatingly, such that, when said display is "opened", only one product panel and an adjacent graphics panel are fully visible.

14. The jewelry display device according to claim 2 further comprising a planar base, having front and back sides, wherein said frame is mounted to said base.

15. The jewelry display device according to claim 14, wherein said frame is rotatably mounted to said base such that said frame can be rotated relative to said base from said front side to said back side to enable one behind said base to change the products on said product display panels or to change the graphics on said graphics display panels.

16. The jewelry display device according to claim 15, further comprising a locking means for locking said frame and for preventing rotation of said frame relative to said base.

17. The jewelry display device according to claim 16, wherein said locking means comprises bolt means disposed through said lower mounting bar and a recess means disposed in said frame for cooperating with said bolt means.

18. The jewelry display device according to claim 17, wherein said locking means functions to lock said frame in said display position, facing said front side of said base.

19. The jewelry display device according to claim 17, wherein said locking means functions to lock said frame in said display changing position, facing said back side of said base.

20. A display device comprising:

a frame;

a first plurality of planar display panels rotatably mounted within said frame; and a second plurality of planar display panels rotatably mounted within said frame;

wherein said display panels all have substantially the same height but said first plurality of display panels are wider than said second plurality of display panels, and wherein said first display panels and said second display panels are mounted alternatingly, such that when one of said first plurality of display panels and an adjacent one of said second plurality of display panels are turned to one side such that said one of said second plurality of display panels is behind said one of said first plurality of display panels, said one of said second plurality of display panels is not normally visible behind said one of said first plurality of display panels.

21. The display device according to claim 20 wherein each of said display panels comprises a mounting pin at both the top edge and the bottom edge thereof for rotatably mounting said panel within said frame.

22. The display device according to claim 21, wherein said frame comprises two substantially parallel mounting bars and a plurality of longitudinally-spaced mounting apertures within each of said mounting bars, within which apertures said mounting pins are rotatably set for rotatably mounting said panels.

23. The display device according to claim 20, wherein each of said first plurality of planar display panels comprises a rectangular panel onto which a plurality of products for display may be removably attached.

24. The display device according to claim 23, wherein each of said second plurality of planar display panels comprises a rectangular panel onto which may be depicted graphics showing the use of said products being displayed on said first plurality of display panels.

25. The display device according to claim 24, wherein said product display panels and said graphics display panels are mounted side by side and alternatingly, such that each of said graphics display panels depicts the use of products being displayed on an adjacent product panel.

26. A display device comprising:

a planar base, having front and back sides;

a frame having two substantially parallel upper and lower mounting bars, said frame being rotatably mounted to said base such that said frame can be rotated 360 degrees relative to said base;

a plurality of planar display panels rotatably mounted within said frame; and a locking means for locking said frame to said base and for preventing rotation of said frame relative to said base.

27. The display device according to claim 26 wherein said locking means comprises a bolt disposed through said lower mounting bar and a recess disposed in said frame for cooperating with said bolt.

28. The display device according to claim 27, wherein said locking means functions to lock said frame in a display position, facing said front side of said base.

29. The jewelry display device according to claim 27, wherein said locking means functions to lock said frame in a display changing position, facing said back side of said base.

30. The jewelry display device according to claim 26 wherein said plurality of planar display panels comprises a plurality of panels for displaying products.

31. The jewelry display device according to claim 30 wherein said plurality of planar display panels further comprises a plurality of panels for displaying graphics.

32. The display device according to claim 31, wherein said product display panels and said graphics display panels are mounted side by side and alternatingly, such that each of said graphics display panels depicts the use of products being displayed on an adjacent product display panel.

33. The jewelry display device according to claim 31 wherein said display panels all have substantially the same height but said plurality of product display panels are wider than said plurality of graphics display panels, and wherein said product display panels and said graphics display panels are mounted alternatingly, such that when one of said product display panels and an adjacent graphics display panel are turned to one side such that said graphics display panels is behind said product display panel, said graphics display panels is not normally visible behind said product display panel.

* * * * *